US005176407A

United States Patent [19]

Vaughn et al.

[11] Patent Number: 5,176,407

[45] Date of Patent: Jan. 5, 1993

[54] TIP-OVER EXHAUST WITH VENTURI

[75] Inventors: Bennie J. Vaughn; James A. Miller; Sandra L. Trotter, all of Cedar Falls, Iowa

[73] Assignee: Deere & Company, Moline, Ill.

[21] Appl. No.: 925,538

[22] Filed: Aug. 5, 1992

[51] Int. Cl.[5] ..... F16L 53/00

[52] U.S. Cl. ..... 285/41; 285/283

[58] Field of Search ..... 285/41, 283, 133.1, 285/138, 153, 154, 132

[56] References Cited

U.S. PATENT DOCUMENTS

| | | | |
|---|---|---|---|
| 2,337,038 | 12/1943 | Fentress | 285/41 |
| 3,063,741 | 11/1962 | Bolkerman | 285/283 |
| 3,345,092 | 10/1967 | Athman et al. | 285/283 |
| 3,352,573 | 11/1967 | Canning | 285/283 X |
| 3,815,941 | 6/1974 | Snyder | 285/283 |
| 4,387,915 | 6/1983 | Adickes . | |
| 4,741,411 | 5/1988 | Stricker . | |

FOREIGN PATENT DOCUMENTS

| | | | |
|---|---|---|---|
| 600031 | 8/1934 | Fed. Rep. of Germany | 285/41 |

*Primary Examiner*—Dave W. Arola

[57] ABSTRACT

A hinged vertical exhaust pipe is provided to allow easy adjustment of the height of the exhaust pipe. The upper and lower sections of the exhaust pipe are hinged together by a stiff joint, e.g., a spring-loaded hinged friction joint, and are positioned in line with one another with a slight gap between them. The lower section is double walled, and the inner wall extends somewhat up into the upper section. The upper section is single walled, with its wall aligned with the outer wall of the lower section. Air is drawn into the space between the inner and outer walls at the base of the lower section and also at a gap at the joint between the upper and lower sections. This air is drawn in both due to the aspiration caused by the higher speed exhaust flow through the inner exhaust pipe, and due to thermal rising of heated air. The space between the inner wall of the lower section and the wall of the upper section acts as a venturi, directing the air in a uniform fashion up into the upper section of the exhaust pipe. This cools the pipe and minimizes blow back at the joint between the upper and lower sections of the pipe.

9 Claims, 2 Drawing Sheets

TIP-OVER EXHAUST WITH VENTURI

BACKGROUND OF THE INVENTION

1. Field of the Invention

The present invention relates to exahust pipes, and in particular to adjustable height vertical exhaust pipes.

2. Description of the Related Art

It is common for work vehicles, e.g., agricultural tractors, to have a vertical exhaust pipe extending well above the other portions of the vehicle to direct the exhaust well away from the operator. However, it is desirable to provide a vehicle with a lower height exhaust pipe in some work environments, for example, in orchards or buildings, to provide clearance.

The same vehicle may be used in both restricted height environments and open field travel. This means that it is desirable to provide some mechanism to convert a standard height vertical exhaust pipe to a low clearance pipe with a minimum amount of effort and no hand tools.

One possibility is to provide a completely removable upper pipe section. This has the disadvantage that the upper pipe section can easily be lost or damaged, and may need hand tools to remove. Some other mechanism therefore is preferable.

The trucking industry sometimes uses a jointed tip-over vertical exhaust for low clearance maneuverability. This eliminates the problem of losing the upper exhaust pipe, but it poses other problems, for example, leakage at the pipe joint when the pipe is in the standard height position.

SUMMARY OF THE INVENTION

The object of the present invention is to provide a vertical stack exhaust pipe which can be converted between a standard height and a low clearance height with a minimum amount of effort and no hand tools.

It is a further object of the present invention to provide such a pipe with a structure which will have minimum exhaust leakage at the joint of the pipe when the pipe is in the standard height position, and which will reduce the outer skin temperature for less radiant heat to the operator and surrounding parts.

These objects are achieved according to the present invention by providing a tip-over exhaust pipe with an internal venturi. The lower portion of the pipe is double-walled. As explained below, cooler, ambient air is drawn up between the walls of the lower pipe, which lowers the skin temperature of the outer pipe. This in turn reduces radiant heat to the operator.

The inner wall of the lower pipe extends up past the outer wall. The upper pipe is pivotally mounted to the lower pipe to be pivotal between an operational position in line with the lower pipe and a storage position approximately 180° from the operational position. The upper pipe is singlewalled, and its wall is in line with the outer wall of the lower pipe when in its operational position.

Far from sealing the joint between the pipes tightly, according to the present invention a gap is intentionally left between the upper end of the lower pipe outer wall and the lower end of the upper pipe wall when the upper pipe is in the operational position. A combination of heat rising and aspiration by exhaust passing from the lower inner pipe into the upper pipe draws air up from both between the walls of the lower pipe and in through the gap. The spacing between the inner wall of the lower pipe and the upper pipe then acts as a venturi, directing and stabilizing the air flow. This simultaneously minimizes blow back through the gap, and provides ambient air to cool the outer wall of the lower pipe and the upper pipe.

Preferably, the pivot connecting the upper pipe section to the lower pipe section is formed by a spring-loaded hinged friction joint. Alternatively, an indexing locking ball-type joint or any other suitable joint which will hold the pipe firmly in its alternative positions can be used. I is preferable for the upper pipe to pivot in a direction to minimize or prevent damage when contacting an object in a forward movement. In the typical situation, this means the pivot should be located at the rear of the pipe to prevent damage.

In addition, if the upper portion of the exhaust pipe is curved to direct exhaust in a particular direction, e.g., away from the operator, the upper end of the inner wall of the lower pipe may be cut at an angle. The highest portion of the inner wall is on the side thereof opposite from the final exhaust opening in the upper pipe. This will assist in directing the exhaust towards that opening.

DETAILED DESCRIPTION OF THE PREFERRED EMBODIMENTS

Figure 1:
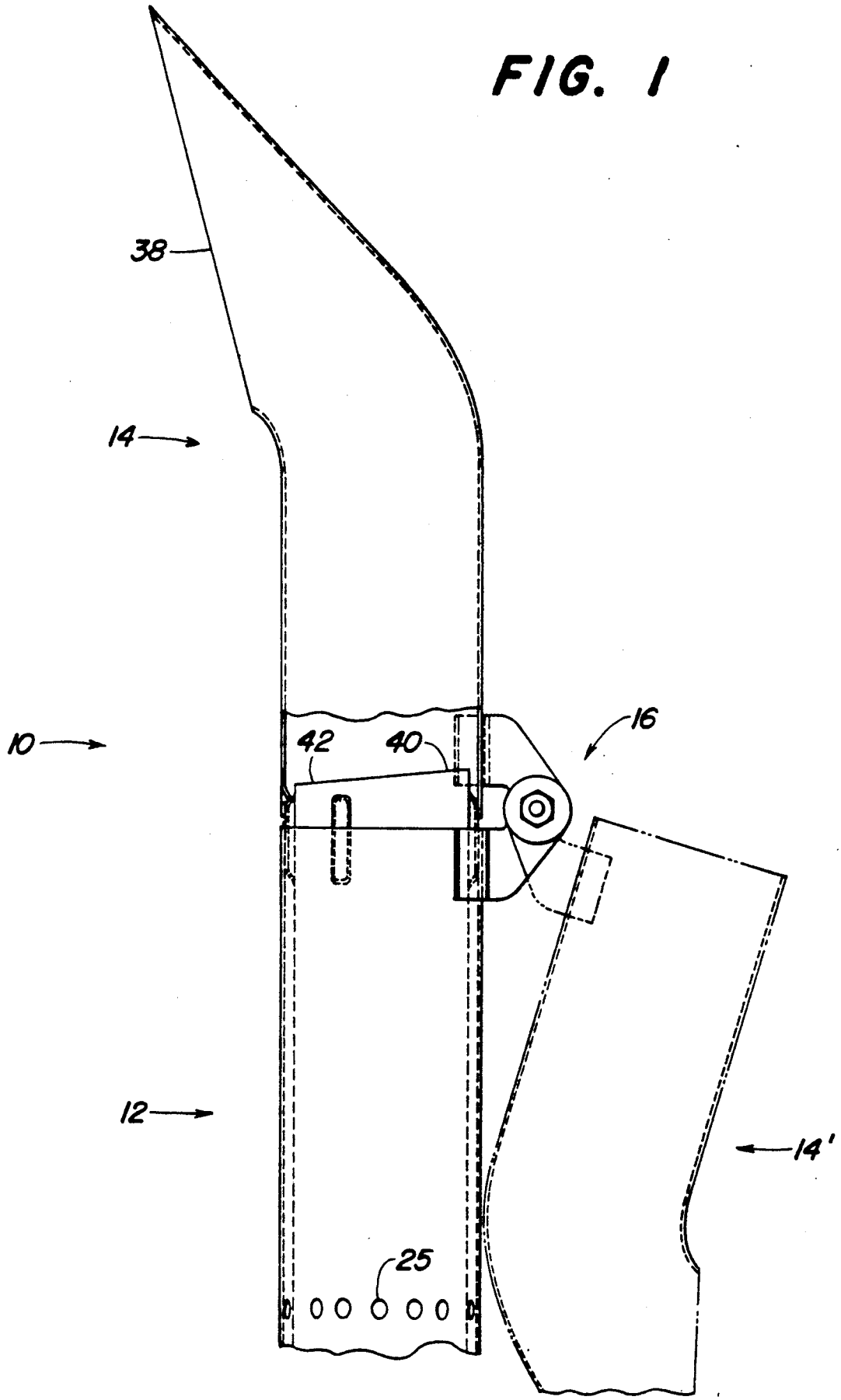
FIG. 1 illustrates an exhaust pipe according to the present invention in its operational position and its storage position (in phantom).

Referring to FIG. 1, an exhaust pipe 10 has a lower section 12 and an upper section 14 connected by a hinge 16. The hinge 16 allows the upper section 14 to pivot between an operational position in line with the lower section 12, and a storage position 14' (shown in phantom) approximately 180° therefrom.

Figure 3:
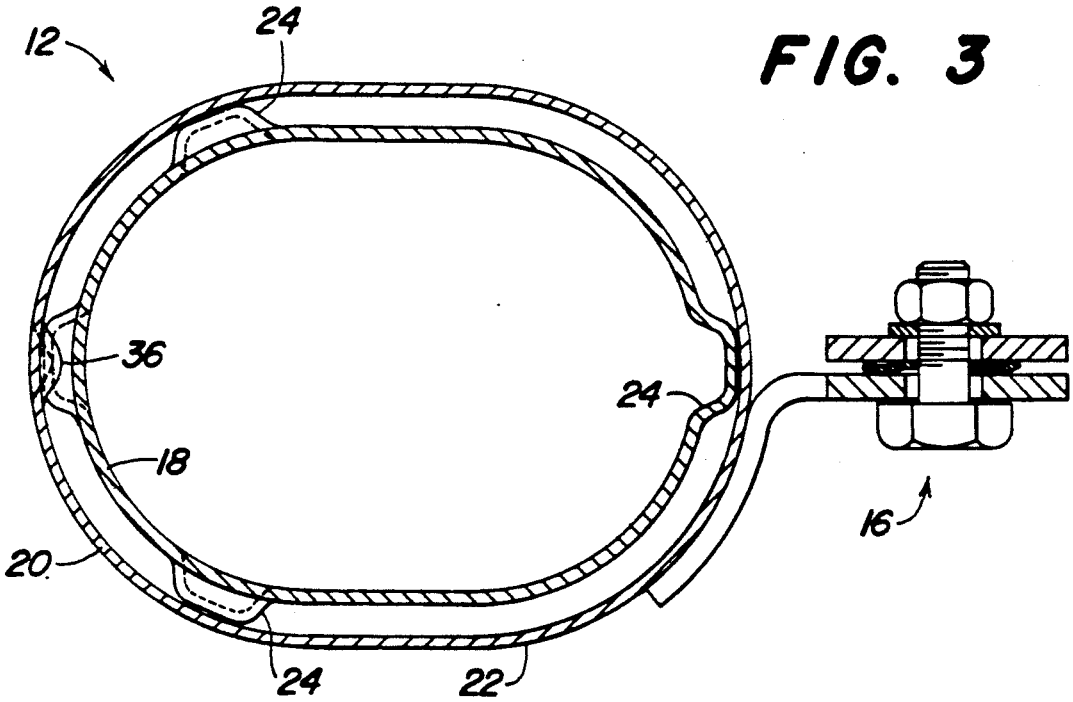
FIG. 3 is a cross-sectional view of the exhaust pipe of FIG. 1 along line 3—3 in FIG. 2.
Figure 2:
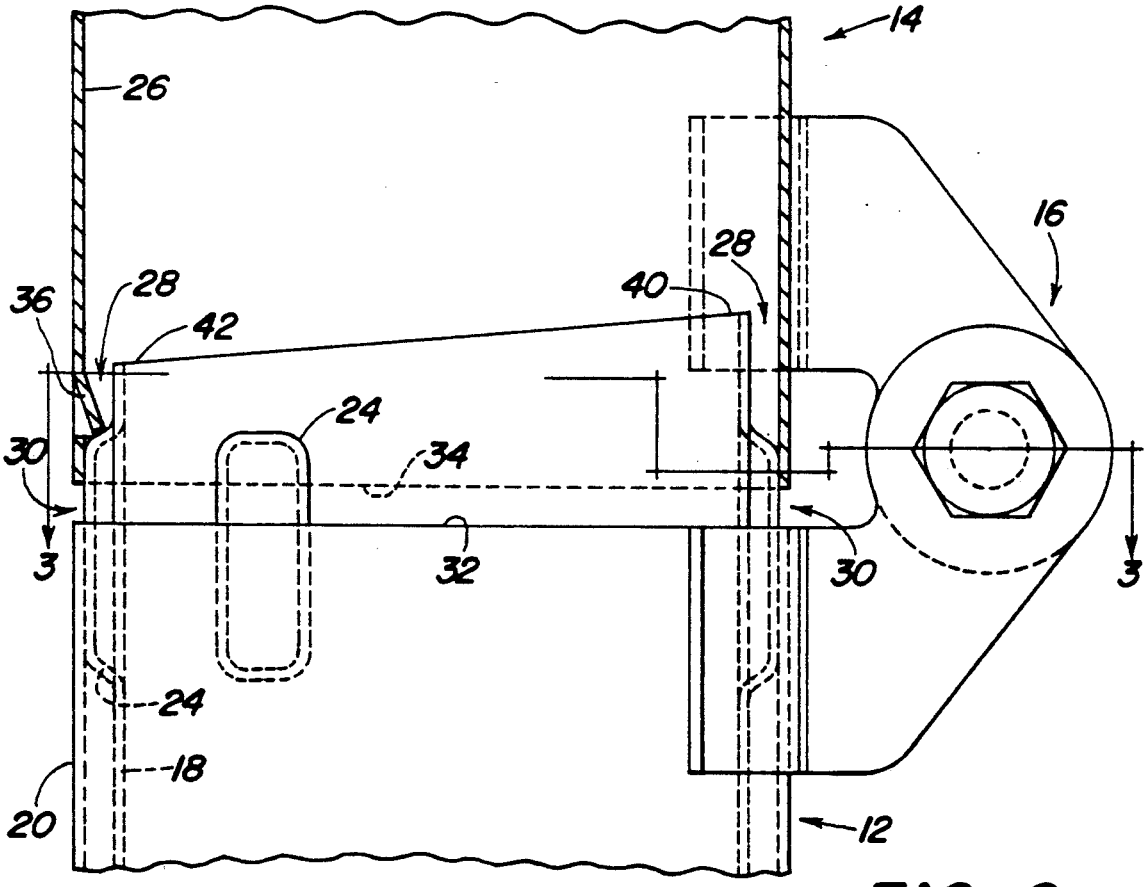
FIG. 2 is a detail of the joint portion of the exhaust pipe in FIG. 1.

As best seen in FIGS. 2 and 3, the lower section 12 has an inner wall 18 and an outer wall 20. A space 22 is maintained between these walls by a suitable mechanism, e.g., pressed out portions 24 of the inner wall 18. Many alternative mechanisms could be used, e.g., welded spacers, punch-ins on the outer wall 20, and the like.

As best seen in FIG. 2, the inner wall 18 of the lower section 12 extends upwards past the outer wall 20 far enough to extend into the upper section 14. The upper section 14 preferably is formed of a single wall 26 which substantially aligns with the outer wall 20 of the lower section 12 when the upper section 14 is in its operational position. As a result, there is a space 28 between the portion of the inner wall 18 which extends into the upper section 14 and the wall 26 of the upper section 14.

When the upper section 14 is positioned in line with the lower section 12, the hinge 16 positions the upper section 14 such that a gap 30 is present between the upper end 32 of the outer wall 20 of the lower section 12, and the lower end 34 of the wall 26 of the upper section 14. Preferably, some mechanism is provided to help the hinge 16 support the upper pipe 14 in this manner. For example, a punch-in 36, best seen in FIGS. 2 and 3, can be provided in the upper section 14 to rest upon one of the punch-outs 24 in the lower section 12.

The hinge 16 preferably is of a type which will stably and firmly hold the exhaust pipe in either the position 14 or the position 14' shown in FIG. 1. Preferably, the hinge 16 can be formed of a spring-loaded friction hinge, as shown in FIG. 3. Alternatively, an indexing locking ball-type hinge could be used, or any other type of hinge which will firmly hold the exhaust pipe in the two positions, but allow a vehicle operator to shift the exhaust pipe from one position to the other without undue force or hand tools.

If the exhaust pipe 10 opens on one side 38 of the upper section 14 as shown in FIG. i, the side 40 of the upper end of the inner wall 18 of the lower section 12 opposite from the opening 38 preferably extends higher into the upper section 14 than the side 42 closest to the exhaust opening 38. This will help direct the exhaust flow towards the opening 38.

The outer wall 20 of the lower section 12 is provided with one or more apertures 25 to allow air to enter the space 22 between the inner wall 18 and outer wall 20 of the lower section 12. Alternatively, any other suitable mechanism to allow air to enter this space near the bottom of the exhaust pipe 10 will suffice.

Preferably, the pipe is flattened into an oval shape as shown in FIG. 3. This reduces the width of the pipe, and, if the pipe is properly aligned, makes it less intrusive to the operator.

Operation

In operation, exhaust from an engine to which the exhaust pipe 10 is connected is blown up inside the inner wall 18 of the lower section 12. Air will be drawn through the apertures 25 into the space 22 between the walls 18, 20 of the lower section 12 by a combination of the heat-induced rise of the air and aspiration by the exhaust stream coming out of the top of the inner tube. Additional air will be drawn in through the gap 30. The space between the walls 18, 26 serves to form a venturi, ensuring a steady direction and flow rate to the air flowing through the exhaust pipe.

This has several effects. First, the air directly cools the outer walls of the lower and upper sections 12, 14, resulting in reduced radiant heat to the operator. Second, the direction and consistency of the air flow provided by the venturi effect helps to reduce exhaust leak or blow back at the hinged joint.

The air flow direction is also affected by the difference in height between the sides 40, 42 of the upper end of the inner wall 18. The higher end 40 tends to direct air away from itself, i.e., towards the side of the exhaust pipe, with the opening 38. This assists in directing the air flow towards that opening. This also helps in directing the exhaust away from the operator with the pipe stored in the low clearance position.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. An adjustable height exhaust pipe, comprising:

a. a lower section having an inner wall and an outer wall, the inner wall defining an exhaust passage, and the inner and outer walls together defining an air space therebetween;

b. an upper section defining an exhaust passage therein;

c. hinge means for pivotally mounting said upper section to said lower section for pivoting said upper section between a storage position not aligned with said lower section and an operational position aligned with said lower section and in which said inner wall extends into said upper section and said hinge means holds said upper section slightly spaced from said outer wall, with said inner wall and said upper section defining a space therebetween.

2. The exhaust pipe of claim 1, wherein the space between said upper section and said inner wall serves as a venturi when exhaust is passed from said lower section to said upper section when said upper section is in said operational position.

3. The exhaust pipe of claim 1, wherein the single wall forming said upper section is substantially aligned with said outer wall when said upper section is in said operational position.

4. The exhaust pipe of claim 1, wherein said upper section has an opening on one side of the upper end thereof, and the top edge of said inner wall on the side opposite from said opening extends further into said upper section than the side closest to said opening when said upper section is in said operational position.

5. The exhaust pipe of claim 1, further comprising a plurality of openings formed said outer wall near the base of said lower section for allowing air to be drawn into the space between said inner and outer walls.

6. The exhaust pipe of claim 1, wherein said upper section is substantially parallel and adjacent to said lower section when in said storage position.

7. The exhaust pipe of claim 1, wherein said hinge means is selected from the group consisting of spring-loaded friction hinges and indexing locking ball-type hinges.

8. The exhaust pipe of claim 1, further comprising stabilizing means for assisting said hinge in holding said upper section spaced from said lower wall when said upper section is in said operational position.

9. The exhaust pipe of claim 1, wherein said sections are oval in cross section.

* * * * *